United States Patent [19]

Adams et al.

[11] 4,026,199

[45] May 31, 1977

[54] SHEET END CUTTER AND STRIPPER

[75] Inventors: David Adams, West Bend; Ralmond J. Smiltneck, Butler, both of Wis.

[73] Assignee: S&S Corrugated Paper Machinery Co., Inc., Brooklyn, N.Y.

[22] Filed: Oct. 6, 1975

[21] Appl. No.: 620,006

[52] U.S. Cl. ..... 93/36 A; 83/103; 83/155.1

[51] Int. Cl.[2] ..... B31B 1/20

[58] Field of Search ..... 93/36 A, 58 R, 58.3, 93/58.4, 59 ES; 83/103, 107, 151, 153, 155.1

[56] References Cited

UNITED STATES PATENTS

| | | | |
|---|---|---|---|
| 3,055,275 | 9/1962 | Schroter | 93/36 A |
| 3,060,776 | 10/1962 | Bobst et al. | 83/103 |
| 3,357,322 | 12/1967 | Gill | 93/36 A |
| 3,524,364 | 8/1970 | Bishop | 93/36 A X |

*Primary Examiner*—James F. Coan
*Attorney, Agent, or Firm*—Ostrolenk, Faber, Gerb & Soffen

[57] ABSTRACT

Sheets of paperboard or the like are gripped along one end by a plurality of grippers and are drawn by the grippers along a predetermined path for processing. An array of stripper tools mounted at the end of the path strips the body of the sheet free from a waste strip which remains gripped by the grippers. The waste strip is carried away from the stripper tools by the grippers and is subsequently released at another station. The stripper blades are driven by a reciprocating drive mechanism which includes a reciprocating slide, a spring urging the slide in one direction, a rotating arcuate cam flange which periodically blocks movement of the slide and periodically frees it for movement, and another rotating cam which reciprocates the slide through one cycle each time it is free to move.

16 Claims, 10 Drawing Figures

4
4

76
84
77
87
88
90
101
100
14
16
32
34
110
108
127
125
126
142
124
122
136
12
144
106
104
102
30
35
28
18
38
80
36
37
128
130
132
129
82
86
83

SHEET END CUTTER AND STRIPPER

BACKGROUND OF THE INVENTION

This invention relates to processing machines for sheet material, e.g., machines for die cutting paperboard boxes out of paperboard sheets. In the past, such machines have included a plurality of grippers for gripping an edge of a paperboard sheet and means for moving the grippers to draw the paperboard sheet along a predetermined path for die cutting and printing. The grippers are attached to a rigid bar which is connected between a pair of endless chains which move the bar along the predetermined path. A plurality of such gripper bars are spaced apart along the chains. The endless chains are driven intermittently to move the paperboard sheets from one work station to another and then to pause while operations are performed on the sheets at each work station.

At one station in such prior art machines the paperboard sheet is die cut into the desired form, with uncut portions being left in the leading edge of the die cut form to keep it attached to the leading waste edge gripped by the grippers. The uncut portions enable the grippers to continue carrying the die cut form along the processing path. At the last work station in the path, the grippers are opened to release the leading waste edge and die cut form, which drop onto a conveyor which carries them out of the machine. The leading waste edge is then manually stripped from the individual die cut forms and the forms are then manually stacked for packaging.

The above-described prior art machine is automatic in all features except for the removal of the leading waste edge from the cut form. Paperboard sheets are fed into the machine automatically from a stack of sheets and are processed automatically at all work stations in the machine. But the product which leaves the machine is not finished and requires manual removal of the leading waste edge by which the die cut form is carried through the machine. Thus the machine's speed is severely limited by the necessity of hand operation on each individual product, which also substantially raises the cost of the process.

SUMMARY OF THE INVENTION

In accordance with this invention, the leading waste edge is severed from the die cut form by an automatically operated blade stripper. The severed waste edge is carried by the grippers away from the strippers and is subsequently released at another station. In preferred embodiments, the release station includes a laterally moving waste conveyor onto which the grippers release the waste strip.

The stripper tool desirably comprises a plurality of stripper blades at one side of the sheet path, a corresponding plurality of anvil blades at the other side of the sheet path. These are oriented to coact with the uncut bridges between the waste strip and the die cut form. Actuating means are provided to move the stripper blades and anvil blades toward each other to substantially concurrently engage one set of blades with the waste strip and the other set of blades with the body of the die cut form, thus to strip the die cut form from the waste strip.

The stripper tools are driven by a reciprocating drive mechanism which includes a reciprocating slide, means urging the slide in one direction, a rotating arcuate cam flange which periodically blocks movement of the slide and periodically frees it for movement, and another rotating cam which reciprocates the slide through one cycle each time it is free to move.

Other objects, features and advantages of the invention will appear from the disclosure hereof.

DESCRIPTION OF THE DRAWINGS

FIG. 9 is an exploded perspective view showing the interconnection between the slide arms for the stripping tool, the torsion bar, and the rocker arms.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
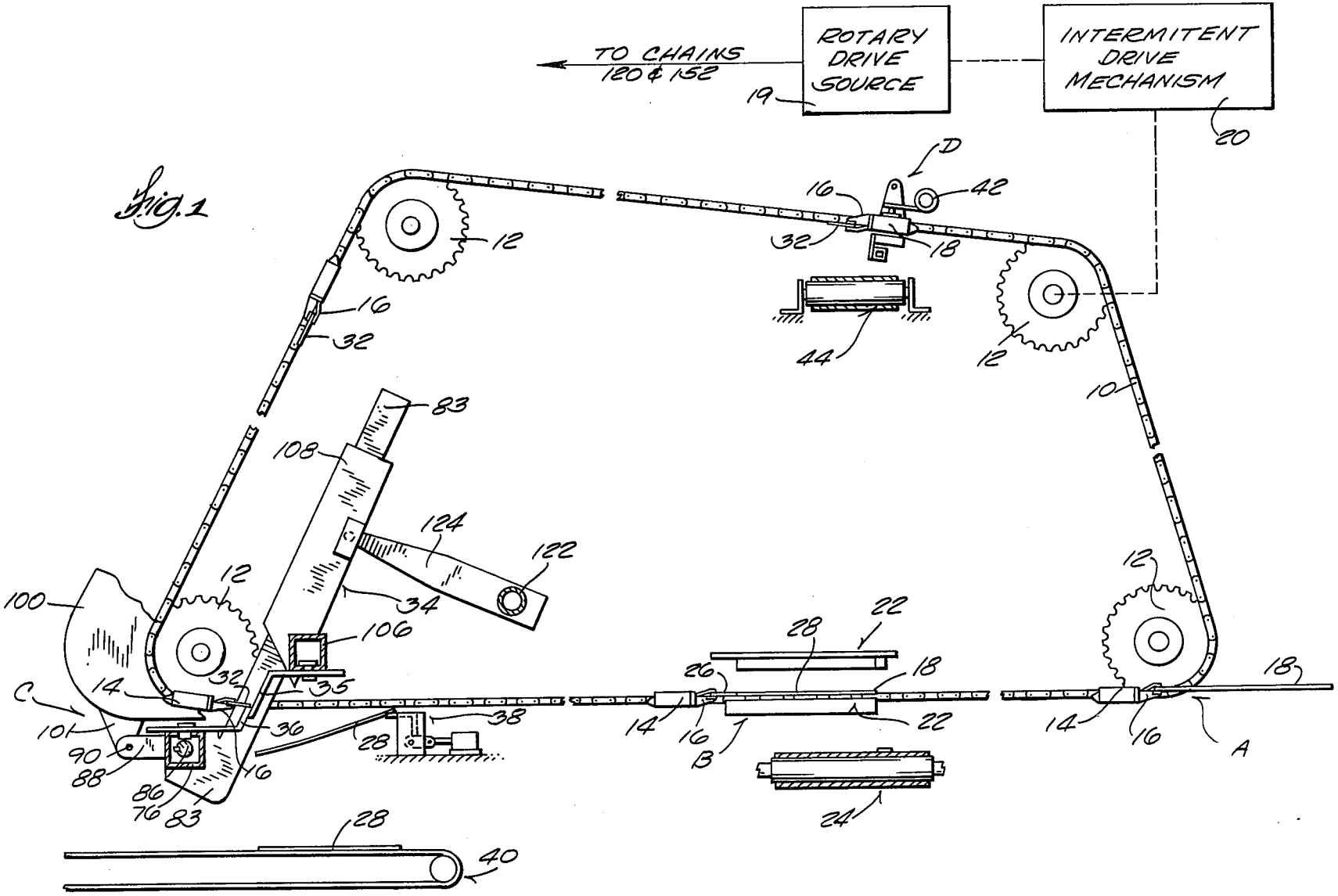
FIG. 1 is a diagrammatic side elevational view of a sheet processing machine utilizing one embodiment of the invention.
Figure 2:
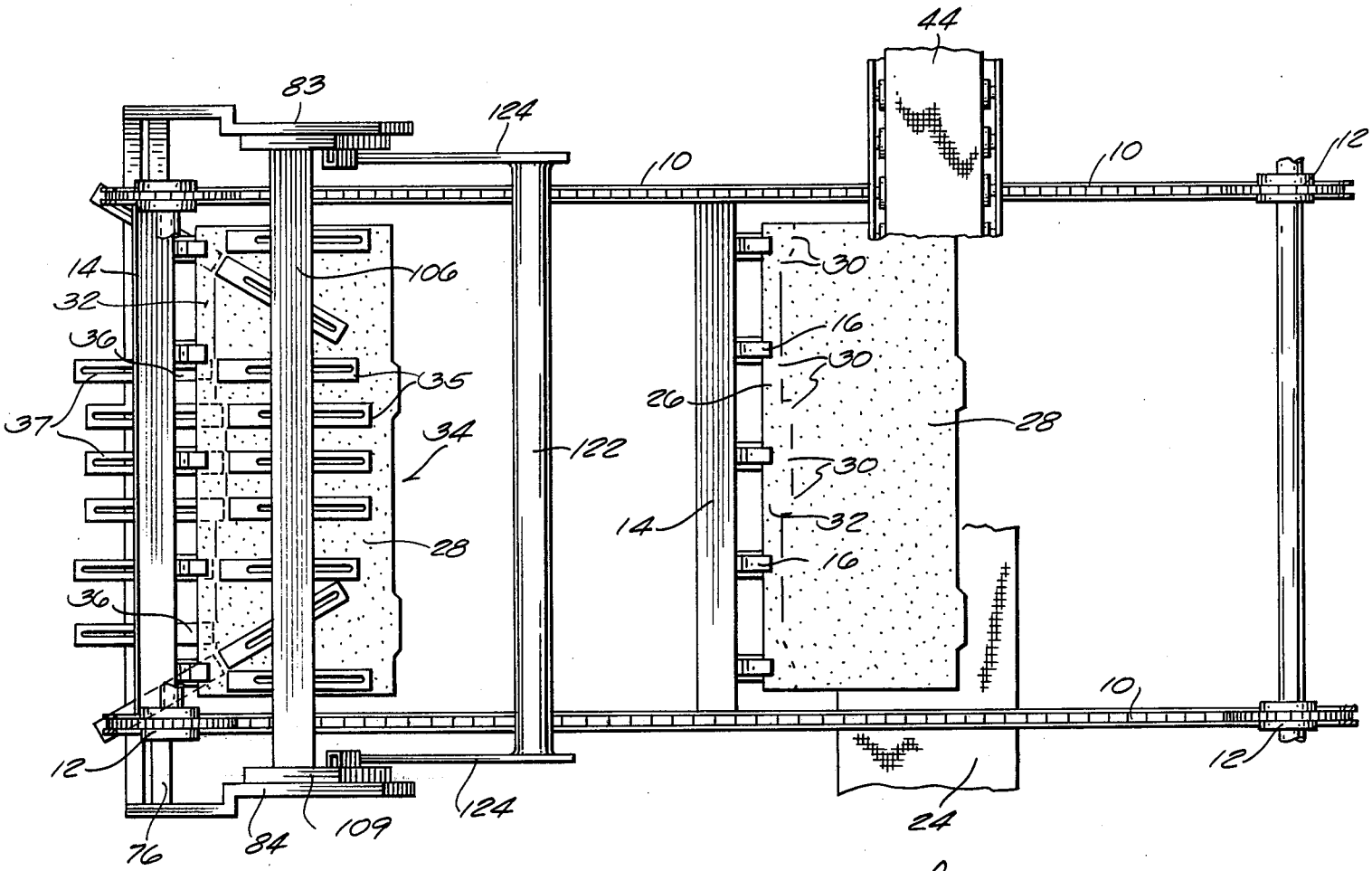
FIG. 2 is a fragmentary plan view of the machine of FIG. 1.
Figures 3, 10:
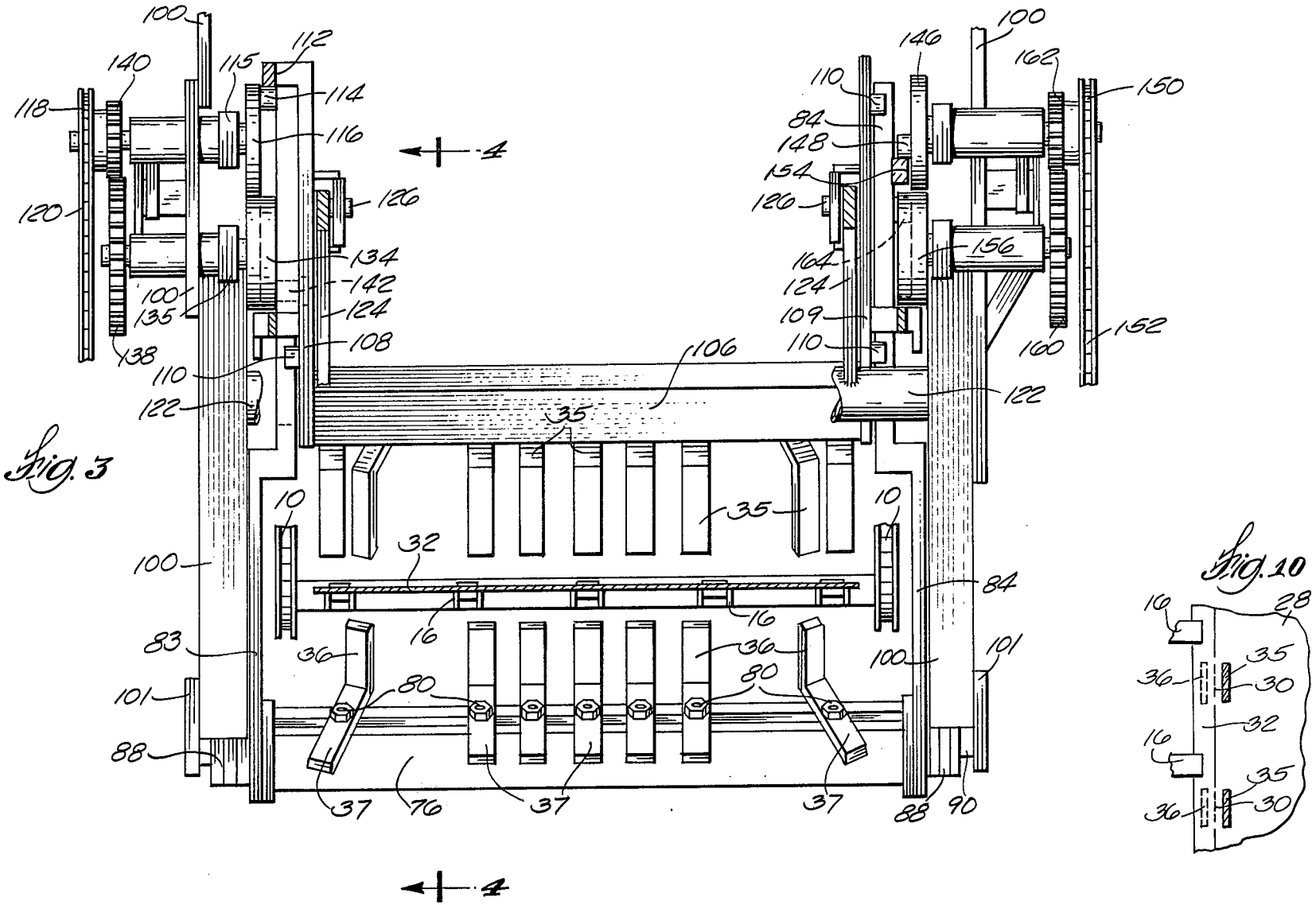
FIG. 3 is a fragmentary end view taken from the left of FIG. 1.
FIG. 10 is a fragmentary diagrammatic view showing the action of the stripper tool blades on the die cut form.

FIGS. 1–3 diagrammatically illustrate the essential portions of a paperboard sheet cutting and printing machine utilizing one embodiment of the invention. The machine includes two endless chains 10 which are each entrained in a vertical plane over rotatable corner sprockets 12 which are journaled to a suitable conventional supporting frame (100 in FIG 4). A plurality of rigid gripper bars 14 each carrying a plurality of laterally spaced apart grippers 16 span between the two chains 10 and move therewith around the closed path defined by the two chains 10. Each gripper bar 14 is connected to chains 10 by conventional couplings which can pass over sprockets 12. Gripper bars 14 are spaced apart along chains 10 by a distance which is an integral divisor of the distance between successive work stations in the machine.

Chains 10, bars 14, and grippers 16 are intermittently driven around their closed path in spurts of movement equal to the distance between successive bars 14, followed by a pause or dwell sufficient for the desired operations to be performed on paperboard sheets 18 at the various work stations. The intermittent drive is applied to one or more of the sprockets 12 on each side of the machine by a conventional intermittent drive mechanism 20, typically a Ferguson drive or the like.

The first work station in the machine is designated by the letter A in the lower righthand corner of FIG. 1. At work station B, a combined cutting die and printer 22 cuts the outline of a desired box or display form 28 in sheet 18 and prints the desired advertising or other indicia thereon. At station B, all of the waste sheetboard, except for the leading waste edge 32, separates from the die cut form 28 and drops onto a lateral waste conveyor 24 which carries it away from the machine. Cutting die and printer 22 and waste conveyor 24 are conventional in structure and hence are not illustrated in detail.

Regardless of the shape of the form 28 which is die cut in sheet 18, the leading edge 26 of the die cut form 28 (FIG. 2) is incompletely cut and has spaced apart perforated or uncut bridge portions 30 by which the die cut form 28 is attached to the leading waste edge 32 which remains in the grip of grippers 16 when the other waste portions have dropped onto conveyor 24. Bridges 30 are typically perforated, so as to be easily severed by the stripper tools at station C. The purpose of bridges 30 is to temporarily maintain the connection between form 28 and waste strip 32 and hence carry the die cut form 28 to the point where it is discharged from the machine. These bridges 30 are best shown in FIG. 10.

The next work station is designated by the letter C in the lower lefthand corner of FIG. 1 and includes an array of stripper tools 34 having spaced upper blades 35 and matching spaced apart lower blades 36 which are adjustably positioned to coincide with corresponding bridges 30 of the die cut form 28 so as to sever the bridges 30 to allow the die cut form 28 to drop free from the leading waste edge 32, which remains in the grip of grippers 16. At the same time, a releasable rear support 38 retracts from the rear end of die cut form 28 and permits the form 28 to drop onto an output conveyor 40 which conveys the finished product 28 to a stackers (not shown).

Stripper tool 34 is an important feature of this invention and is described in detail in subsequent paragraphs.

The next work station is designated by the letter D in the upper righthand portion of FIG. 1. At work station D, the grippers 16 are opened by a pivotal opener 42 (FIG. 7) to permit the leading waste edge 32 to drop onto a second laterally moving waste conveyor 44. The preferred form of pivotal opener 42 is shown in detail in FIG. 7 and is described in subsequent paragraphs.

From the foregoing description, it will be apparent that the sheets 18 are first gripped by grippers 16 at work station A and are carried along a predetermined path for processing which includes die cutting sheets 18 at work station B and severing the die cut forms 28 from leading waste edge 32 at work station C. Leading waste edge 32 is then discharged at work station D and the empty grippers 16 return to work station A to start another cycle.

Figure 7:
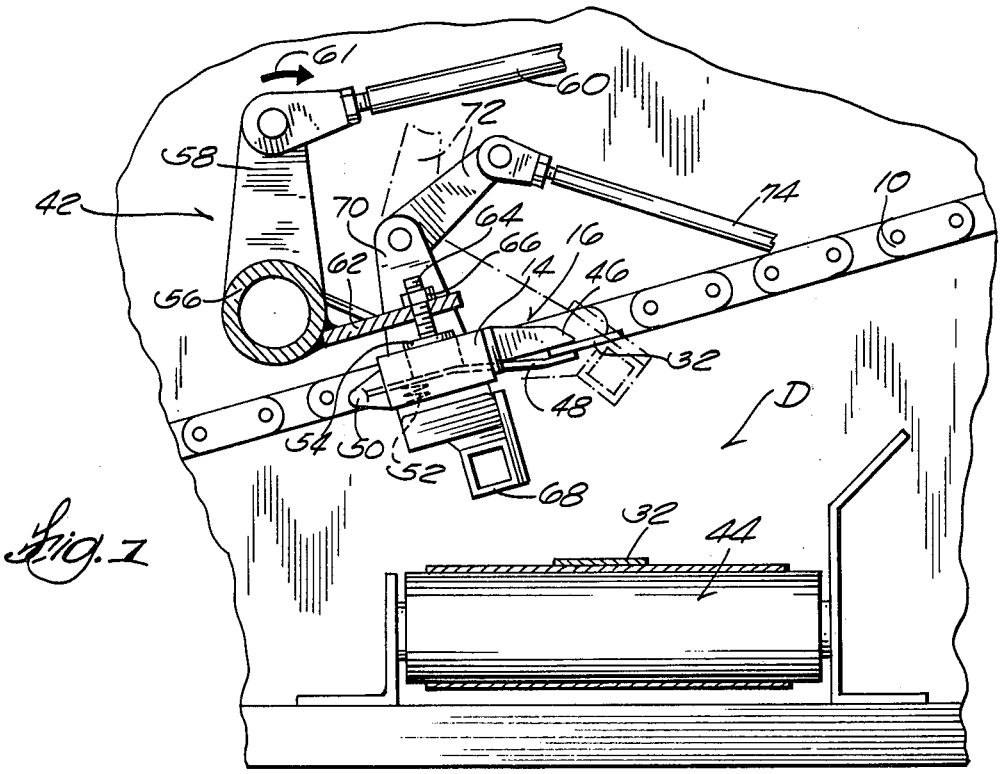
FIG. 7 is an enlarged fragmentary side elevational view of the mechanism for releasing the leading waste edge from the grippers and for stripping the leading waste edge therefrom.

The distance along chains 10 between each adjacent pair of work stations is equal to an integral multiple of the distance between gripper bars 14 so that grippers 16, die form 28 and/or waste strip 32 will be correctly aligned with the cooperating mechanism at each work station in turn. FIG. 7 shows how the grippers 16 are opened at work station D to release leading waste edge 32. Each gripper 16 includes a fixed finger 46 and a movable finger 48 which is pivoted to bar 14 on pintle 50 and is normally pressed against fixed finger 46 by a compression spring 52. A cylindrical button 54 is attached to movable finger 48 and projects outwardly beyond an opening in bar 14. When button 54 is pressed, it forces movable finger 48 away from fixed finger 46. When button 54 is released, it enables spring 52 to press movable finger 48 against fixed fingers 46, or against any material that is inserted between fixed finger 46 and movable finger 48.

Pivotal opener 42 includes a tube 56 which extends across the machine above bar 14. Tube 56 is pivotally connected at its ends to the machine frame by conventional bearing means not shown and has a pair of crank arms 58 each rigidly attached to an opposing end of tube 56 and each pivotally attached at its other end to a pusher rod 60.

A plurality of actuating arms 62 are also rigidly attached to tube 56 and each extend above a corresponding button 54 on bar 14. A threaded stud 64 and length adjusting nut 66 are engaged in a threaded opening in the end of each actuating arm 62. When crank arms 58 and tube 56 are pivoted in the direction of arrow 61 in FIG. 7, each stud 63 is pressed against the corresponding button 54 to open all grippers 16. When crank arms 58 and tube 56 are pivoted in the direction opposite arrow 61 in FIG. 7, each stud 64 is lifted off the corresponding button 54 to enable springs 52 to close grippers 16.

In some embodiments, waste edge 32 might not weigh enough to reliably detach itself from grippers 16 when they are opened. In such embodiments it is desirable to utilize a stripper which can include a stripping bar 68 which is pivotally supported by a pair of crank arms 70 at opposite ends of bar 68. Each crank arm 70 is located outside the corresponding chain 10 to prevent interference with the movement of chains 10 and gripper bars 14. Crank arms 70 are rigidly attached to actuation arms 72, which are pivotally attached to pusher rods 74. When actuation arms 72 and crank arms 70 are rotated clockwise in FIG. 7, they swing stripping bar 68 up to the position indicated by broken lines in FIG. 7, where stripping bar 68 strikes waste edge 32 and dislodges or strips it from the opened grippers 16. Stripping bar 68 is then moved back to the position shown in full lines to avoid blocking movement of bars 14 and fingers 16. Pusher rods 60 and 74 are driven in synchronism with the cutting stroke of stripper tool 34 by conventional linkage means (now shown) during each pause in the intermittent drive of chains 10 and bars 14.

Figures 2, 4:
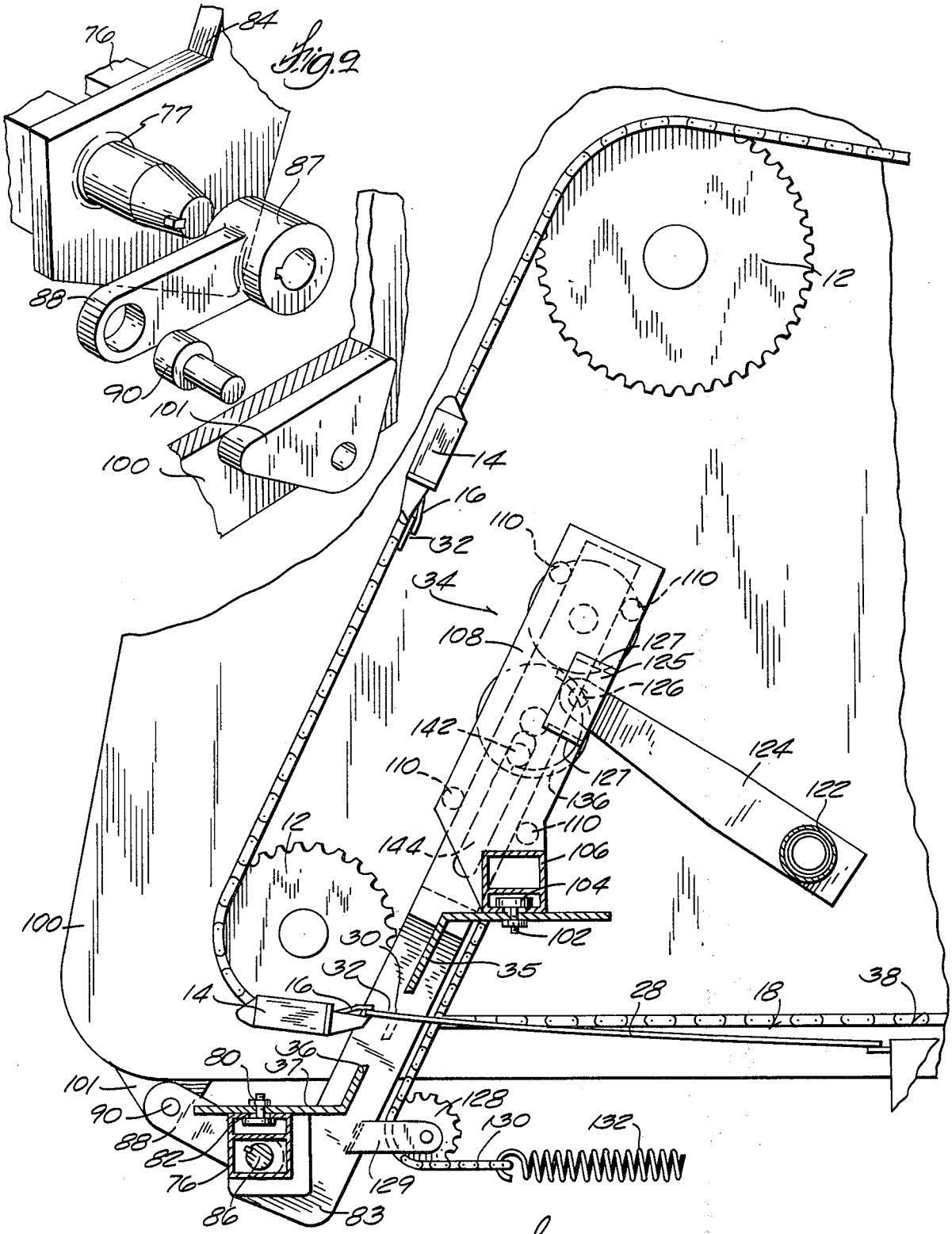
FIG. 4 is an enlarged fragmentary diagrammatic side elevation view of a stripper tool and the reciprocating drive means therefor.

FIGS. 3–6 show the details of the novel reciprocating drive mechanism for multi-blade stripping tool 34. The lower or anvil blades 36 of tool 34 are adjustably mounted on a lower box section crossbar 76 (FIGS. 3 and 4) which is hollow and is rectangular in cross section (FIG. 4). Each blade 36 is L-shaped and has a foot portion 37 adjustably mounted to crossbar 76 by a bolt-type clamp 80 which is engaged in a slot 82 of crossbar 76. Blades 36 can be set at any desired position within their range of adjustment to correspond to the bridges 30 on the leading end of die cut form 28.

Crossbar 76 is supported at its ends by a pair of slide arms 83, 84 at opposite sides of the machine. These are connected to opposite ends of box section crossbar 76 and extend upwardly therefrom. Slide arm 84 on the right side of FIG. 3 is raised by a cam mechanism described hereinafter when anvil blades 36 are moved upward to a stripping position. Such upward movement is conveyed to the slide arm 83 at the other end of crossbar 76 by a torsion bar 86 (FIG. 4) which is inside the hollow crossbar 76 (FIG. 9). Torsion bar 86 is keyed at its ends to the hubs 87 of rocker arms 88 which are pivoted on pins 90 to brackets 101 fixed to machine frame 101. Accordingly, when slide arm 84 is lifted, rocker arm 88 will swing about pin 90, thus turning torsion bar 76 on its own axis, thus to swing rocker arm 88 at the opposite side of the machine and lift slide arm 83. Crossbar 76 and blades 36 do not partake of the swinging motion of rocker arms 88, because of bearings 77. They have an orbital motion about pivot pin 90.

The upper blades 35 of stripper tool 34 are adjustably connected by clamps 102 (FIG. 3) to a slot 104 in an upper box section crossbar 106 which is also hollow and is rectangular in cross section. Adjustable clamps 102 enable blades 35 to be adjusted to any desired position within their range of adjustment to match the blades 36 below them. The position of crossbar 106 is determined by a pair of slide arms 108 and 109 disposed at opposite sides of the machine and which are rigidly connected to opposite ends of upper crossbar 106. Slide arms 108, 109 are slidably connected and guided to lower slide arms 83 and 84 by paired rollers 110.

On the top end of the slide arm 108 at the lefthand side of FIG. 3 is a flat cam follower flange 112 which is supported by a cam roller 114. Cam roller 114 is mounted on a cam disk 116 which is journaled on bearing 115 (FIG. 6) to the frame 100 of the machine. Disk 116 is coupled to a drive sprocket 118 which is continuously rotated by a drive chain 120. As disk 116 rotates, it causes cam roller 114 to periodically rise and fall. Cam follower flange 112 rises and falls with cam roller 114 to cause a reciprocating motion of slide arm 108. The reciprocating motion of slide arm 108 is transmitted to slide 109 on the opposite end of crossbar 106 through a torsion bar 122 (FIG. 4) which is journaled to the frame by conventional means not shown and is linked at its opposite ends to slides 108 and 109 through arms 124. Arms 124 are rigidly attached at one end to torsion bar 122 and are pivotally connected to slides 108 and 109 at the opposite end by pintles 126 which are attached to slide blocks 125 which can move laterally in ways 127.

The transverse coupling through torsion bar 122 insures that slide arms 108 and 109 will rise and fall together even though only slide arm 108 is driven. This moves all of the upper blades 35 up and down simultaneously. The same function is performed for lower blades 36 by lower torsion bar 86 and its pivotal links 88, which insure that slide arms 83 and 84 will rise and fall together even though only slide 84 is driven.

Slide arm 84 of the lower blade assembly has a sprocket 128 (FIG. 4) journaled thereto on a bracket 129. A chain 130 engages and extends around sprocket 128. The upper end of chain 130 is pinned or otherwise attached to upper crossbar 106 and the lower end of chain 130 is attached to an expansion spring 132 whose other end is pinned or attached to the machine frame 100. Spring 132 is normally expanded and generates a downward force on the upper blade assembly (upper cross bar 106, blades 35, slide arms 108 and 109, etc.) and an upward force on the lower blade assembly (lower crossbar 76, blades 36, slide arms 83 and 84, etc.). This normally urges blades 35 and 36 toward each other and will produce a stripping action of blades 35 and 36 when the slide arms 83, 84 and 108, 109 are free to move.

Both the upper and lower blade assemblies are reciprocated between a rest position shown in FIG. 4 and a stripping position shown in FIG. 1. The reciprocating action of blades 35 and 36 is derived through a cam mechanism which blocks the movement of slide arms 84 and 108 when conveyor chain 10 is in motion, then frees the slide arms 84 and 108 for motion when conveyor chain 10 is stopped. Another cam mechanism, driven at twice the speed of the first-mentioned cam mechanism, allows slide arms 84 and 108 to move toward each other under the pull of spring 132 to cause a stripping stroke of blades 35 and 36, and then moves slide arms 84 and 108 away from each other to separate blades 35 and 36 back to the rest position shown in FIG. 4. The first-mentioned cam mechanism then blocks movement of slide arms 84 and 108 again while conveyor chain is in motion during the next cycle.

The first-mentioned cam mechanism which blocks the movement of slide arm 84 includes a cam disk 134 (FIGS. 3, 5, 6 and 8) which has an arcuate annular flange 136 (FIG. 6) extending outward around the periphery thereof on one-half (180°) of the disk periphery. Cam disk 134 is journaled to frame 100 on bearing 135 and is rotated by a speed reducing gear 138 (FIG. 3) which engages and is driven by a gear 140 on the shaft of cam disk 116. Gears 140 and 138 are arranged to drive cam disk 134 at one-half the speed of cam disk 116 which carries cam roller 114.

Figure 8:
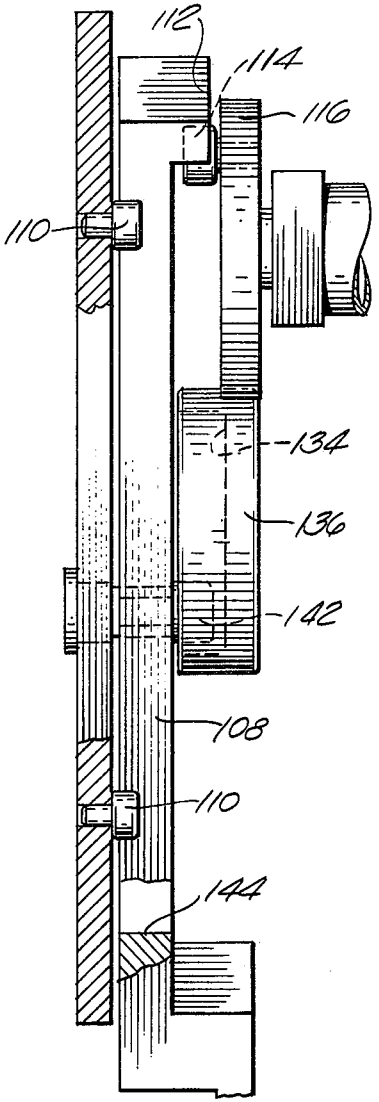
FIG. 8 is a cross section taken along the line 8—8 of FIG. 5.
Figure 5:
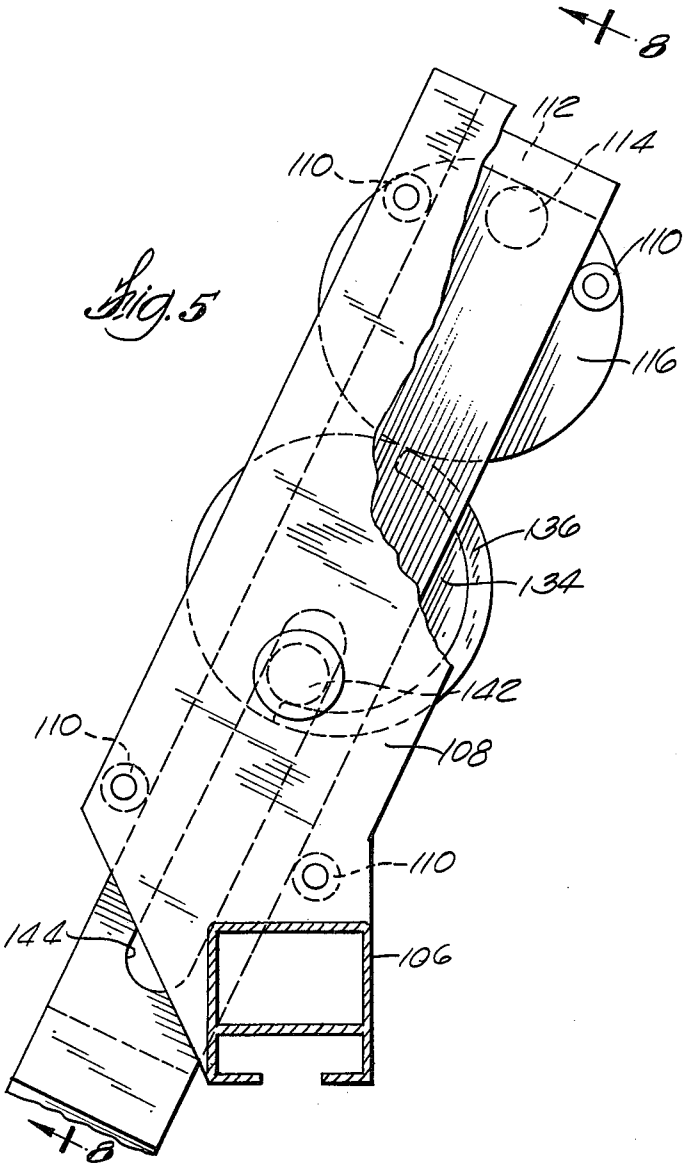
FIG. 5 is an enlarged side elevational detailed view of the slide and rotating cams of one reciprocating drive mechanism.
Figure 6:
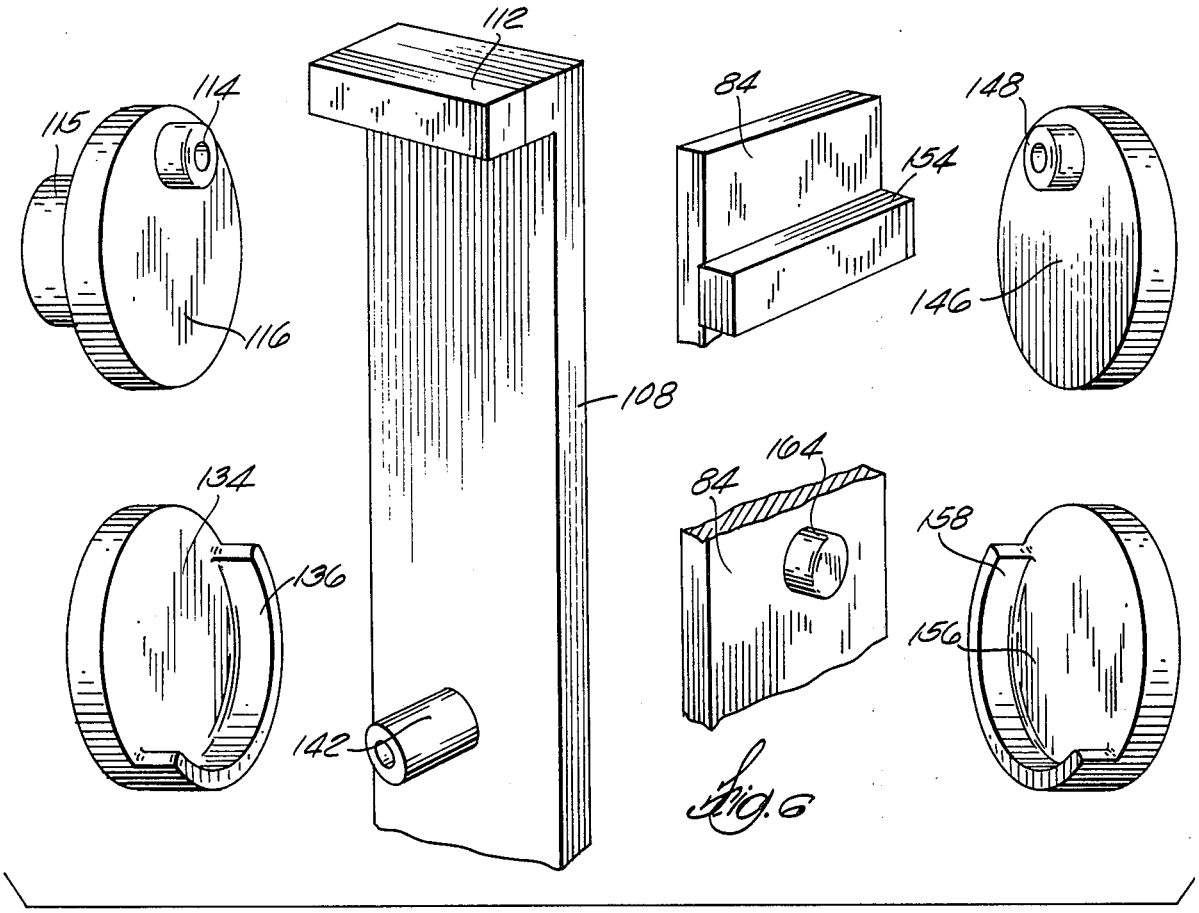
FIG. 6 is a diagrammatic exploded perspective view of the rotating cams and their cam followers for both reciprocating drive mechanisms.

A cam roller 142 (FIGS. 3 and 6) is rotatably attached to slide 108 and extends outwardly toward arcuate cam flange 136 of cam disk 134. Cam roller 142 passes through a slot 144 (FIGS. 4, 5) in lower slide arm 83 and rollably engages arcuate cam flange 136 as shown in FIGS. 5 and 8 during the half cycle of rotation of cam disk 134 when cam flange 136 is opposite cam roller 142. During this half cycle of rotation, downward movement of cam roller 142 is blocked. This blocks downward movement of slide arm 108 and the entire upper blade assembly which is attached thereto (crossbar 106, blades 35, slide arm 109, etc.).

During the next half cycle of rotation of cam disk 134 when cam flange 136 is not opposite cam roller 142, slide arm 108 is free to move downward and is reciprocated downwardly in a stripping stroke and then upwardly in a return stroke by the combined action of spring 132 (FIG. 4), cam roller 114 (FIGS. 3, 6) and flat cam flange 112. Since cam roller 114 rotates at twice the speed of cam disk 134, cam roller 114 rotates through a complete cycle in the time period that the 180° arcuate cam flange 136 is not engaged with its opposing cam roller.

At the end of the stripping and return stroke described above, arcuate cam flange 136 engages cam roller 142 again and blocks motion of slide 108 again. Cam disks 116 and 134 are synchronized with each other by being driven by a common drive chain 120, which is driven from the rotary drive source 19 for intermittent drive mechanism 20 (FIG. 1) so that cam disks 116 and 134 will also be synchronized with the intermittent movement of conveyor chain 10. The speed of rotation of cam disk 116 is timed so that one full rotation thereof occurs in the pause time interval for conveyor chain 10 to cause one stripping cycle to occur during the pause time interval.

In this embodiment, the movement time of conveyor chain 10 is equal to the pause time thereof, and hence the cam disk 134 which inhibits movement of slide 108 is rotated at one-half the speed of cam disk 116. However, in other embodiments, the movement time of conveyor chain 10 may be longer than the pause time thereof, and in such cases the rotational speed of cam disk 134 will be correspondingly slower with respect to the rotational speed of cam disk 116. For example, if the movement time of conveyor chain 10 were twice as long as the pause time thereof, cam disk 134 would be rotated at one-third the speed of cam disk 116 and the arcuate cam flange 136 would cover two-thirds of the periphery of cam disk 134 instead of one-half of the periphery. Other examples will be apparent to those skilled in the art. In all cases, however, the speed of cam disk 116 will be an integral multiple of the speed of cam disk 134.

As the upper blade assembly (crossbar 106, knives 35, slides 108, 109, etc.) is being driven down in a stripping stroke, as described above, the lower blade assembly (crossbar 76, blades 36, slide arms 83, 84, etc.) is being driven up in a matching stripping stroke by spring 132 (FIG. 4) and by a pair of cam mechanisms which are similar to the cam mechanisms described above, but which are located on the other side of the machine (on the right-hand side of FIG. 3). The cam mechanisms for the lower blade assembly includes a cam disk 146 (FIGS. 3, 6) carrying a cam roller 148 which is journaled to frame 100 and is rotated by a drive sprocket 150 and drive chain 152. Cam roller 148 rides on top of a linear cam flange 154 on slide 84. As cam roller 148 rises and falls through a complete cycle, it allows slide arm 84 to rise under the pull of spring 132 and then pushes slide arm 84 back to its original position, thereby producing a reciprocating motion which causes a cutting stroke and return stroke of the lower blade assembly. The stripping stroke and return stroke of the lower knife assembly is synchronized with the stripping stroke and return stroke of the upper blade assembly by virtue of the fact that drive chains 120 and 152 are both driven from the common drive source 19 (FIG. 1) and that cam disk 146 rotates at the same speed as cam disk 116.

The other cam mechanism for the lower blade assembly includes another cam disk 156 (FIGS. 3, 6) having an arcuate cam flange 158 that extends around half (180°) of the periphery of cam disk 156. Cam disk 156 is journaled to frame 100 and is rotated by speed reducing gears 160 (FIG. 3) and 162, which drive cam disk 156 at one-half the speed of cam disk 146. A cam roller 164 is rotatably attached to slide arm 84 opposite arcuate cam flange 158 and engages flange 158 to inhibit motion of slide arm 84 during one-half of the rotary cycle of cam disk 156. The time period during which the motion of slide arm 84 is inhibited coincides with the time period during which conveyor chain 10 is in motion. During the pause time of conveyor chain 10, arcuate cam flange 158 is clear of roller 164, thereby permitting slide 84 to reciprocate through an upward stripping stroke and a downward return stroke for the lower blade assembly as described above. During the stripping stroke, cam roller 148 rises and permits slide arm 84 to rise under the force of spring 132 (FIG. 4). During the return stroke, cam roller 148 presses down on linear cam flange 154 and pushes slide arm 84 back to its original position shown in FIG. 4. Cam roller 164 then engages arcuate cam flange 158 again and inhibits motion of slide arm 84 during the next half cycle of cam disk 158.

The die cut form 28 is thus stripped from the clamped leading waste strip edge 32 of sheet 18 at station C by the interaction of upper blades 35 and lower anvil blades 36 acting on the bridges 30. Anvil blade 36 supports waste strip 32 while upper blade 35 ruptures the bridges 30 and strips the die cut form 28 loose from the waste strip 32. The blades 35, 36 may act as coacting knife edges, but this is not necessary in most cases as the bridges 30 are preweakened by perforations and the like so that the impact of blade 35 against the form 28 suffices to strip it from the gripped strip 32. FIG. 10 diagrammatically illustrates the fact that the blades 35, 36 of the stripping tool are not necessarily aligned during their coaction. It is important primarily that anvil blade 36 support the waste strip 32 as stripping blade 35 strikes the die cut form 28, thus to prevent the impact of blade 35 on form 28 from dislodging the strip 32 from the grip of grippers 16.

Anvil blades 36 will orbit counterclockwise (in FIGS. 1 and 4) about the axis of pivot pins 90 as they rise to coact with stripper blades 35. Accordingly, blades 35 will not ordinarily have any shearing action with stripping blades 35, as blades 36 will typically be forwardly offset from bridges 30 as the stripping blades strike the die cut form 28.

As aforestated, the grippers 16 then carry the waste strip 32 to its disposal station D.

We claim:

1. In a machine for processing sheet material and including at least one gripper for gripping a partially severed waste edge strip of a piece sheet material, and means for moving said gripper along a predetermined path to draw the gripped sheet therealong for processing, the improvement comprising a stripping tool mounted at a first work station adjacent to said predetermined path and positioned to strip the body of said sheet material from the waste edge thereof, means for actuating said stripping tool to completely sever said body from said strip, and means at a second work station adjacent to said path for opening said gripper to release said waste edge strip, a stripper element mounted adjacent to said path at said second work station, said stripper element being movable into contact with said waste edge strip to dislodge the waste edge strip from the gripper when the latter is opened, and means for moving said stripper element into contact with said waste edge strip when said gripper is opened.

2. The machine defined in claim 1 wherein said means for moving said gripper comprises an intermittent drive for intermittently moving said gripper from one work station to another, each movement interval being followed by a stationary interval during which work is performed on said sheet material, and wherein said means for actuating said stripping tool is synchronized with said intermittent drive means to actuate said stripping tool during said stationary intervals.

3. The machine defined in claim 1 wherein said gripper is moved over a closed path, and further comprising a lateral waste conveyor under said gripper at said second work station for conveying the released waste edge strip away from the machine.

4. The machine defined in claim 1 and further comprising a third work station at which a cutting die is mounted for cutting a predetermined form in said sheet material, said cutting die being mounted upstream from said stripping tool along the path of said gripper, the leading edge of said cutting die being operable to leave uncut portions between said waste edge strip and said die cut form, and said stripping tool having a spaced plurality of blades and means for adjusting the position of said blades to match the position of said uncut portions.

5. The machine defined in claim 1 wherein said gripper includes a fixed finger and a movable finger, spring means urging said movable finger toward said fixed finger, and wherein said means for opening said gripper includes means for applying pressure to said movable finger to move it away from said fixed finger against the force of said spring means.

6. The machine defined in claim 1 and further comprising a plurality of grippers mounted in spaced apart relationship on a gripper bar, and means for moving said gripper bar along said predetermined path.

7. The machine defined in claim 6 and further comprising a plurality of gripper bars each carrying a plurality of grippers mounted in spaced apart relationship thereon, a pair of endless conveyor chains, means movably mounting said conveyor chains along said predetermined path, and said gripper bars being connected between said chains in spaced apart relationship along said path.

8. In a machine for processing sheet material and including at least one gripper for gripping a partially severed waste edge strip of a piece of sheet material, and means for moving said gripper along a predetermined path to draw the gripped sheet therealong for processing, the improvement comprising a stripping tool mounted at a first work station adjacent to said predetermined path and positioned to strip the body of said sheet material from the waste edge thereof, means for actuating said stripping tool to completely sever said body from said strip, and means at a second work station adjacent to said path for opening said gripper to release said waste edge strip, said stripping tool including at least one blade assembly movably mounted on the machine for movement between a stripping position and a retracted position, and further comprising a reciprocating drive means for reciprocating said blade assembly between said stripping position and retracted position, said reciprocating drive means comprising spring means urging said blade assembly toward one of its two positions, a first cam mechanism periodically freeing said blade assembly for movement, a second cam mechanism periodically driving said blade assembly through a stripping stroke and return stroke during the time period when it is free for movement, said first cam mechanism including a cam disk having an arcuate cam flange projecting from a portion of the periphery thereof, means rotatably mounting said cam disk on said machine adjacent to a portion of said blade assembly, a cam roller mounted on a portion of said blade assembly in position to engage said arcuate cam flange to periodically prevent movement of said blade assembly and periodically free it for movement, and wherein said second cam mechanism includes a second cam disk having a cam roller thereon, means rotatably mounting said second cam disk on said machine adjacent to a portion of said blade assembly, a cam follower mounted on a portion of said blade assembly adjacent to said cam roller in position to engage said roller, means for rotating said first cam disk at a predetermined speed, and means for rotating said second cam disk at a speed which is an integral multiple of said predetermined speed for said first cam disk.

9. The machine defined in claim 8 and further comprising a second blade assembly movably mounted on the machine for movement between a stripping position and a retracted position in cooperation with the first-mentioned blade assembly, and including a second reciprocating drive means for reciprocating said second blade assembly between a stripping position and retracted position, said second reciprocating drive means including spring means urging said second blade assembly toward one of its two positions and first and second cam mechanisms as defined in claim 8.

10. The machine as defined in claim 8 wherein said arcuate cam flange extends approximately 180° around the periphery of said first cam disk, and wherein said second cam disk is rotated at twice the speed of said first cam disk.

11. The machine defined in claim 9 wherein said first reciprocating drive means is mounted on one side of said first and second blade assemblies and said second reciprocating drive means is mounted on the other side of said first and second blade assemblies, and also comprising a first torsion bar coupled to said first blade assembly for transmitting forces from one side of said blade assembly to the other, and a second torsion bar coupled to said second blade assembly for transmitting forces from one side of said second blade assembly to the other.

12. The machine defined in claim 11 wherein a single spring means is coupled to both blade assemblies urging both toward their cutting position.

13. The machine defined in claim 11 wherein both blade assemblies include a plurality of blades adjustably mounted on a supporting bar positioned to coact with the blade of the other blade assembly.

14. In a machine for processing sheet material and including at least one gripper for gripping a partially severed waste edge strip of a piece of sheet material, and means for moving said gripper along a predetermined path to draw the gripped sheet therealong for processing, the improvement comprising a stripping tool mounted at a first work station adjacent to said predetermined path and positioned to strip the body of said sheet material from the waste edge thereof, means for actuating said stripping tool to completely sever said body from said path for opening said gripper to release said waste edge strip, said stripping tool including an anvil blade mounted at one side of said path and a stripping blade mounted at the other side of said path, said means for actuating said stripping tool comprising means for concurrently moving said blades toward said path to substantially concurrently engage one said blade with the waste edge strip and the other said blade with the body of the sheet material.

15. The machine of claim 14 in which said stripping tool comprises a plurality of such stripping blades and anvil blades, crossbars on which said blades are mounted in opposed paired relation, said means for concurrently moving the blades toward each other comprising means on which one crossbar is reciprocated between a stripping position and a retracted position and means on which the other crossbar is orbited between a stripping position and a retracted position.

16. The machine of claim 15 in which reciprocating slide arms are connected at opposite ends of each crossbar, said means for concurrently moving said blades toward each other comprising torsion bars spanning across said machineand interconnecting corresponding slide arms whereby reciprocating motion imparted to slide arm at one side of the machine will be imparted to the corresponding slide arm at the other side of the machine.

* * * * *

UNITED STATES PATENT AND TRADEMARK OFFICE

CERTIFICATE OF CORRECTION

PATENT NO. : 4,026,199

DATED : May 31, 1977

INVENTOR(S) : DAVID ADAMS & RALMOND J. SMILTNECK

It is certified that error appears in the above-identified patent and that said Letters Patent are hereby corrected as shown below:

Column 8 - line 34 - after "piece" please insert --of--

Column 10 - line 63 - delete "machineand" and replace with --machine and--

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*